US007325598B2

(12) United States Patent
Bartlett

(10) Patent No.: US 7,325,598 B2
(45) Date of Patent: Feb. 5, 2008

(54) VACUUM ASSISTED SEAL ENGAGEMENT FOR ROV DEPLOYED EQUIPMENT

(75) Inventor: Christopher D. Bartlett, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 404 days.

(21) Appl. No.: 10/698,771

(22) Filed: Oct. 31, 2003

(65) Prior Publication Data

US 2004/0216885 A1 Nov. 4, 2004

Related U.S. Application Data

(60) Provisional application No. 60/423,283, filed on Nov. 1, 2002.

(51) Int. Cl.
*E21B 29/12* (2006.01)

(52) U.S. Cl. ..... 166/75.13; 166/360; 166/368

(58) Field of Classification Search ..... 166/339, 166/340, 341, 343, 360, 368, 366, 75.13, 166/97.1; 137/81, 82
See application file for complete search history.

(56) References Cited

U.S. PATENT DOCUMENTS

| | | | | |
|---|---|---|---|---|
| 4,566,722 | A | 1/1986 | Huber et al. | |
| 4,649,704 | A | 3/1987 | Marsh | |
| 4,682,913 | A | 7/1987 | Shatto et al. | |
| 4,777,800 | A | 10/1988 | Hay, III | |
| 5,107,931 | A * | 4/1992 | Valka et al. | 166/342 |
| 5,992,526 | A | 11/1999 | Cunningham | |
| 6,050,339 | A * | 4/2000 | Milberger | 166/368 |
| 6,076,605 | A * | 6/2000 | Lilley et al. | 166/368 |
| 6,202,753 | B1 | 3/2001 | Baugh | |
| 6,474,416 | B2 * | 11/2002 | Beall et al. | 166/343 |
| 6,494,266 | B2 * | 12/2002 | Bartlett et al. | 166/339 |
| 6,615,923 | B1 * | 9/2003 | Lay et al. | 166/368 |
| 6,817,417 | B2 * | 11/2004 | Blair et al. | 166/335 |
| 7,025,132 | B2 * | 4/2006 | Kent et al. | 166/87.1 |
| 7,051,804 | B1 * | 5/2006 | Arning | 166/97.1 |
| 7,096,956 | B2 * | 8/2006 | Reimert | 166/348 |
| 2001/0011593 | A1 * | 8/2001 | Wilkins | 166/368 |
| 2002/0088622 | A1 | 7/2002 | Beall et al. | |

FOREIGN PATENT DOCUMENTS

| | | |
|---|---|---|
| GB | 2 320 513 A | 6/1998 |

* cited by examiner

*Primary Examiner*—Thomas A Beach
(74) *Attorney, Agent, or Firm*—Henry C. Query, Jr.

(57) ABSTRACT

A method and apparatus for attaching a first component which comprises a depending portion to a second component which comprises a bore that is sized and configured to receive the depending portion, wherein the first and second components are exposed to a fluid which is at an ambient pressure, comprises the steps of inserting the depending portion at least partially into the bore and then creating a bore pressure within the bore which is less than the ambient pressure. In this manner a pressure difference between the ambient pressure and the bore pressure will force the depending portion into the bore to thereby attach the first component to the second component.

49 Claims, 6 Drawing Sheets

FIG. 2
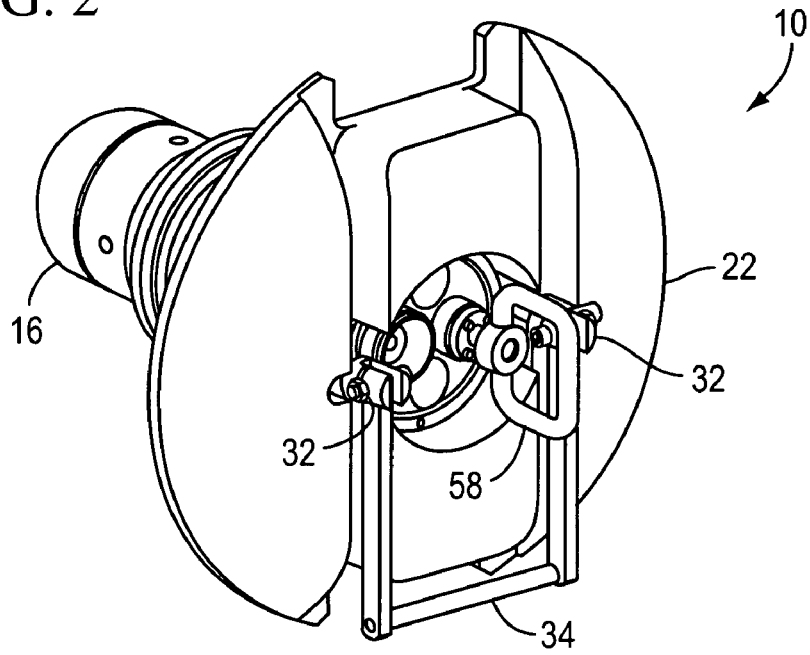
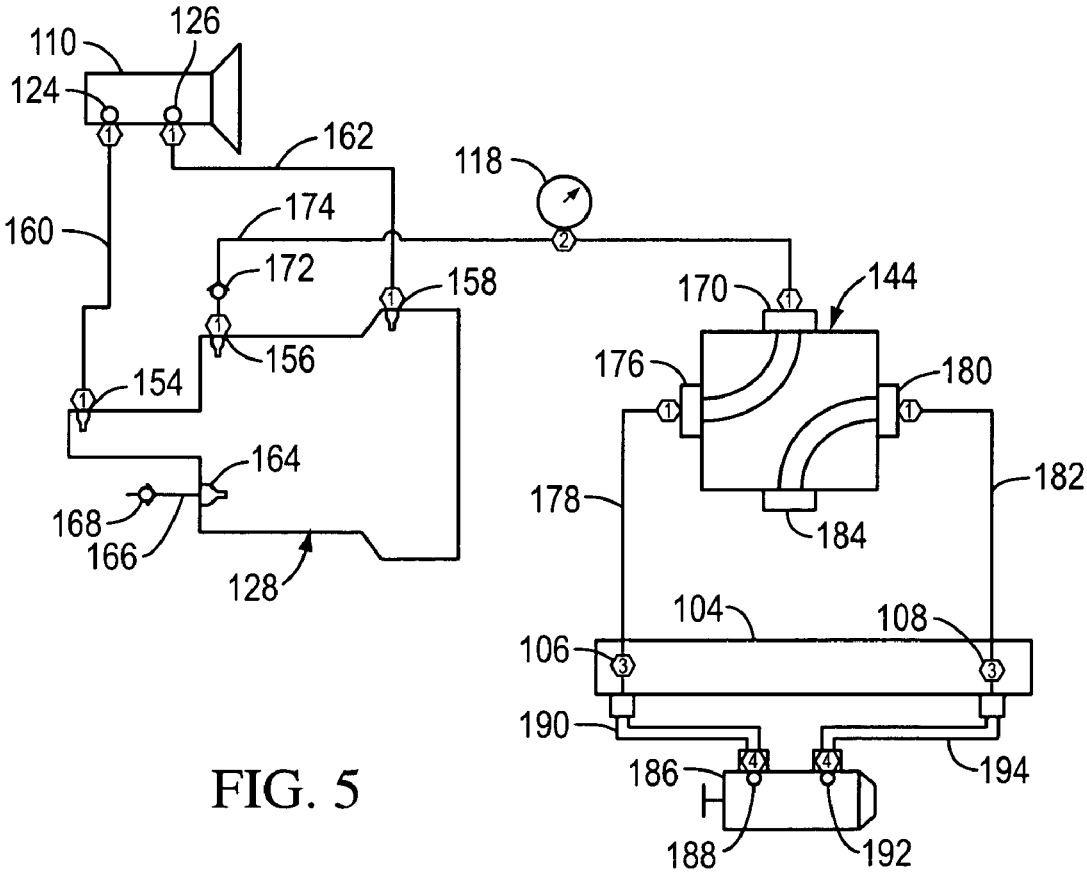
FIG. 5

FIG. 6
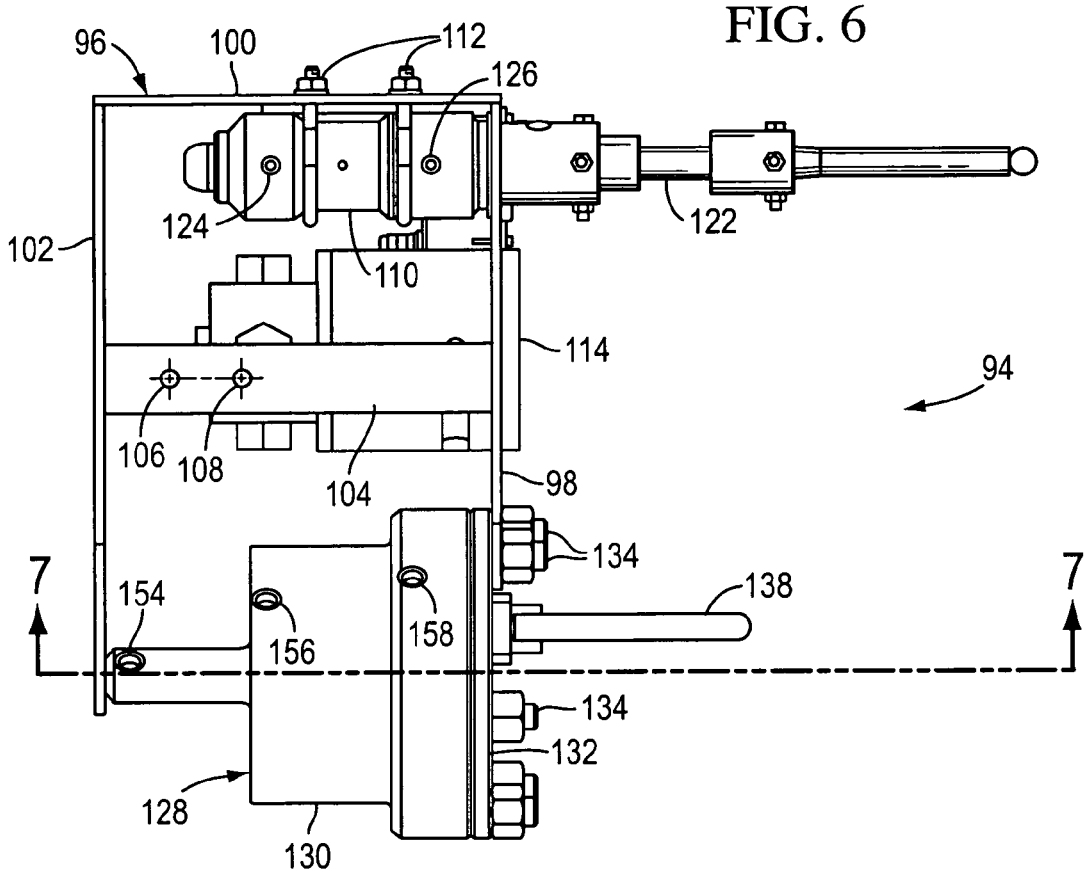
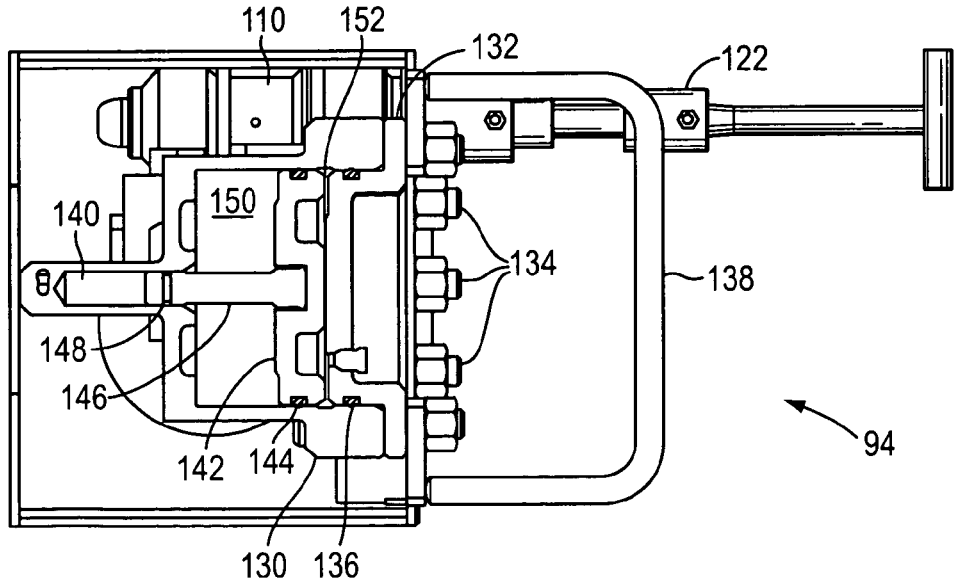
FIG. 7

VACUUM ASSISTED SEAL ENGAGEMENT FOR ROV DEPLOYED EQUIPMENT

This application is based on and claims priority from U.S. Provisional Patent Application No. 60/423,283, which was filed on Nov. 1, 2002.

BACKGROUND OF THE INVENTION

The present invention is directed to a method and apparatus for attaching a first component to a second component. More particularly, the invention is directed to such a method which comprises inserting a depending portion of the first component at least partially into a bore of the second component and then evacuating the bore to create a pressure differential across the first component which will force the depending portion into the bore to thereby attach the first component to the second component. In one illustrative embodiment, the present invention is directed to a method and apparatus for installing a tree cap on a subsea christmas tree using a remotely operated vehicle ("ROV").

A prior art method for installing a tree cap on a subsea christmas tree is described in U.S. Pat. No. 5,992,526, which is commonly owned herewith. In this patent, the tree cap comprises a seal plate which is adapted to seal within a bore of the tree, a hydraulic setting piston which drives the seal plate downwardly into the bore, and a hydraulic lockdown piston which forces a lockdown ring into engagement with the inner diameter of the tree to thereby lock the tree cap to the tree. However, in order to accommodate the hydraulic setting and lockdown pistons, the tree cap must be provided with corresponding piston chambers and conduits for connecting the piston chambers to a source of hydraulic fluid, and this necessarily increases the size, weight and complexity of the tree cap.

Furthermore, the downward forces on the seal plate and the lockdown piston create upwardly directed reaction forces on the tree cap which must be countered to prevent the tree cap from being pushed off the tree. In the aforementioned patent, these reaction forces are countered by providing the tree cap with a pair of inwardly biased latch pins which engage corresponding grooves formed on the outer diameter of the tree. However, requiring the tree cap to be latched to the outer diameter of the tree increases the size, weight and complexity of the tree cap. Such a requirement also necessitates the additional step of disengaging the latch pins prior to retrieving the tree cap.

SUMMARY OF THE INVENTION

In accordance with the present invention, these and other disadvantages in the prior art are overcome by providing a method for attaching a first component which comprises a depending portion to a second component which comprises a bore that is sized and configured to receive the depending portion, wherein the first and second components are exposed to a fluid which is at an ambient pressure. The method comprises the steps of inserting the depending portion at least partially into the bore and then creating a bore pressure within the bore which is less than the ambient pressure. In this manner a pressure difference between the ambient pressure and the bore pressure will force the depending portion into the bore to thereby attach the first component to the second component.

In accordance with one embodiment of the invention, the method further comprises the step of providing a seal on at least one of the depending portion and the bore and then inserting the depending portion into the bore until the seal engages both the depending portion and the bore. The seal will thus ensure that the bore pressure is isolated from the ambient pressure.

The present invention also encompasses an apparatus for attaching a first component which comprises a depending portion to a second component which comprises a bore that is sized and configured to receive the depending portion, wherein the first and second components are exposed to a fluid which is at an ambient pressure. The apparatus comprises a fluid conduit which extends through at least one of the first and second components and communicates with the bore, and means in fluid communication with the fluid conduit for removing at least a portion of the fluid from the bore. In this manner, when the depending portion is inserted at least partially into the bore, the fluid removing means will create a bore pressure within the bore which is less than the ambient pressure. Consequently the pressure difference between the ambient pressure and the bore pressure will force the depending portion into the bore to thereby attach the first component to the second component.

Thus, the present invention offers several advantages over the prior art. First, since ambient pressure is employed to force the depending portion into the bore, the first component need not be provided with a setting piston and an associated piston chamber. Second, since the first component does not include a setting piston or similar mechanism for forcing the depending portion into the bore, the first component will not be subjected to any upwardly directed reaction forces. Thus, no need exists to latch the first component to the second component prior to forcing the depending portion into the bore. Furthermore, the first component can be detached from the second component by simply creating a pressure within the bore which is greater than the ambient pressure.

These and other objects and advantages of the present invention will be made apparent from the following detailed description, with reference to the accompanying drawings.

BRIEF DESCRIPTION OF THE DRAWINGS

FIG. 2 is a perspective view of the tree cap of FIG. 1;

FIG. 5 is a schematic representation of the hydraulic system of the ROV suction tool of the present invention;

FIG. 6 is a side plan view of the ROV suction tool of the present invention;

FIG. 7 is a partial cross sectional view of the ROV suction tool taken along line 7-7 of FIG. 6;

DETAILED DESCRIPTION OF THE PREFERRED EMBODIMENTS

The present invention comprises an apparatus and method for facilitating the installation of a first component into a bore or cavity of a second component. The invention is particularly useful when the second component is located remotely, such as in the case of a subsea completion system. Accordingly, the present invention may be used to effect the installation of a first component into a corresponding second component in a subsea completion system using, for example, an ROV. For purposes of simplicity, however, the invention will be described herein in connection with a tree cap for a subsea christmas tree.

Figure 1:
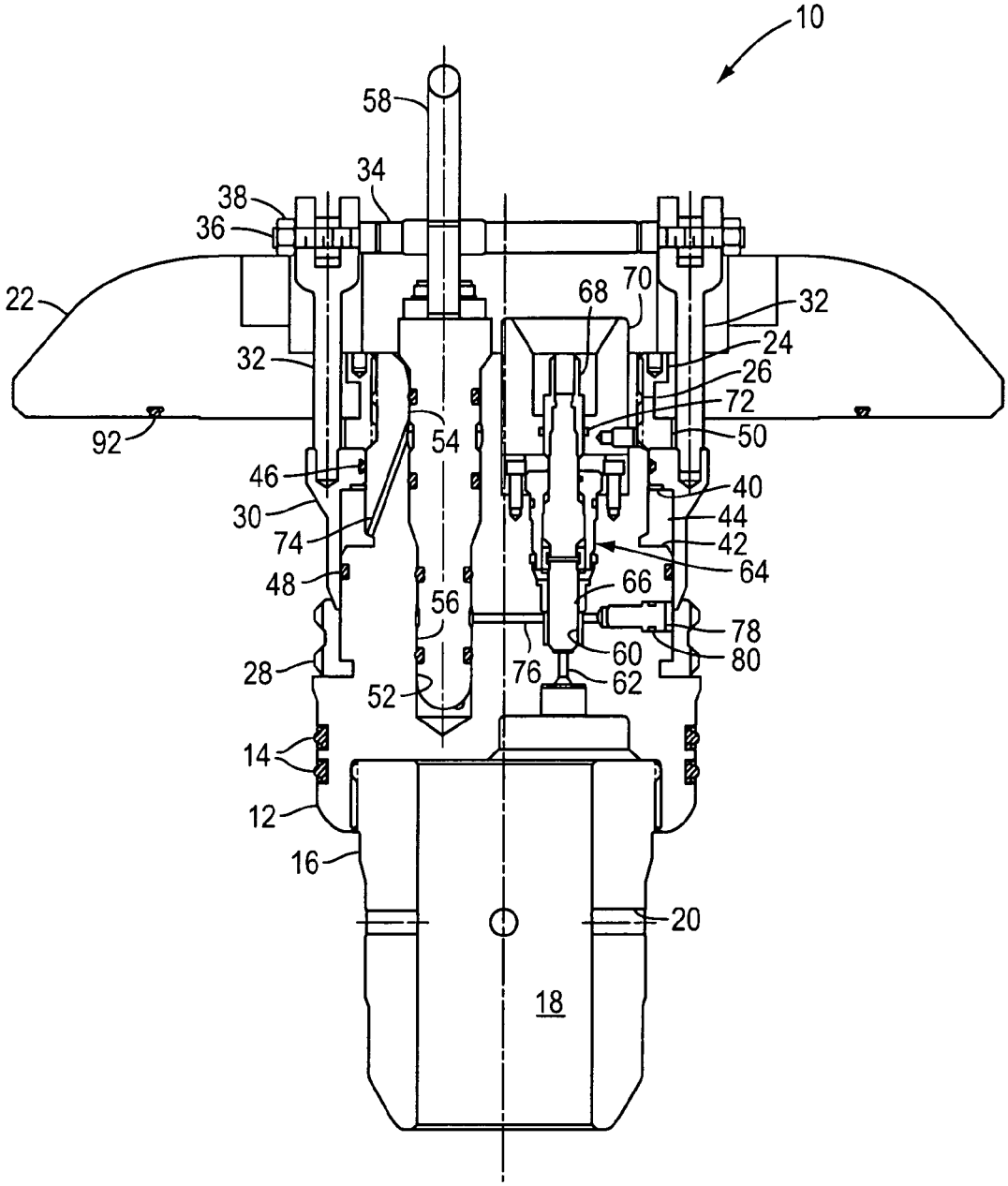
FIG. 1 is a cross sectional view of a tree cap which is constructed in accordance with the present invention.

Referring to FIGS. 1 and 2, the tree cap, which is indicated generally by reference number 10, is shown to comprise an annular seal plate 12, a number of elastomeric seals 14 which are mounted on the outer diameter surface of the seal plate, a stab nose 16 which is secured such as by threads to the bottom of the seal plate and which includes a longitudinal central bore 18 and a number of generally lateral vent ports 20, and an upper body 22 which is attached to the top of the seal plate by, for example, an internally threaded hold down ring 24 which is secured to the seal plate and engages an inwardly extending flange 26 on the upper body. The seal plate 12 is preferably made of metal, while the stab nose 16 and the upper body 22 are ideally made of a lightweight plastic or other suitable polymeric material in order to limit the overall in-water weight of the tree cap, which preferably is less than about 100 pounds. Alternatively, the stab nose 16 and the upper body 22 may be omitted entirely.

The tree cap 10 also comprises an inwardly biased split lockdown ring 28 which is mounted on the seal plate 12, an annular lockdown piston 30 which is positioned on the seal plate immediately above the lockdown ring, ideally two piston release rods 32 which are secured such as by threads to the top of the lockdown piston at preferably diametrically opposed locations and extend upwardly through corresponding orifices in the upper body 22, and an optional ROV handle 34 which is pivotally mounted to the release rods such as with bolts 36 and nuts 38. An internally projecting flange 40 on the lockdown piston 30 cooperates with an upwardly facing shoulder 42 on the seal plate 12 to define a lockdown piston chamber 44 which is sealed by, for example, upper and lower O-ring seals 46 and 48 which are positioned between the lockdown piston and the seal plate. In addition, upward movement of the lockdown piston 30 is ideally limited by a stop ring 50 which is secured such as by threads to the seal plate 12 below the hold down ring 24. Alternatively, upper movement of the lockdown piston 30 may be limited by the bottom of the upper body 22, the bottom of the hold down ring 24, or both.

Referring specifically to FIG. 1, the seal plate 12 comprises a hot stab bore 52 which is adapted to receive a conventional dual port hot stab (not shown). The hot stab bore 52 is provided with upper and lower annular galleries 54 and 56 which are positioned to communicate with corresponding upper and lower fluid ports in the dual port hot stab when it is inserted into the bore. During initial deployment of the tree cap 10, a dummy stab 58 is installed in the hot stab bore 52.

The seal plate 12 also includes a needle valve bore 60, a first fluid port 62 which extends between the needle valve bore and the central bore 18 of the stab nose 16, and a conventional needle valve 64 which is secured in the needle valve bore. The needle valve 64 comprises a valve needle 66 which is positioned in the bottom of the needle valve bore 60 and a needle valve stem 68 which is connected to the valve needle. As is well known in the art, the needle valve 64 is configured such that rotation of the needle valve stem 68 via an ROV tool or other means results in axial movement of the valve needle 66. In this manner, the fluid port 62 can be selectively opened or closed by rotating the needle valve stem 68. The tree cap 10 may comprise a receptacle 70 which is secured in the upper end of the needle valve bore 60 to guide an ROV tool into engagement with the needle valve stem 68, in which event the receptacle is preferably sealed to the needle valve stem by a suitable seal, such as an O-ring seal 72.

The seal plate 12 further includes a second fluid port 74 which extends between the lockdown piston chamber 44 and the upper gallery 54 of the hot stab bore 52, and a third fluid port 76 which extends from the outer diameter surface of the seal plate, through the needle valve bore 60 and to the lower gallery 56 of the hot stab bore. The end of the third fluid port 76 adjacent the outer diameter surface of the seal plate 12 is sealed with a plug 78 and an associated seal 80. Thus, when the needle valve 64 is open, the central bore 18 of the stab nose 16 is fluidly connected with the lower gallery 56 of the hot stab bore 52.

Figure 3:
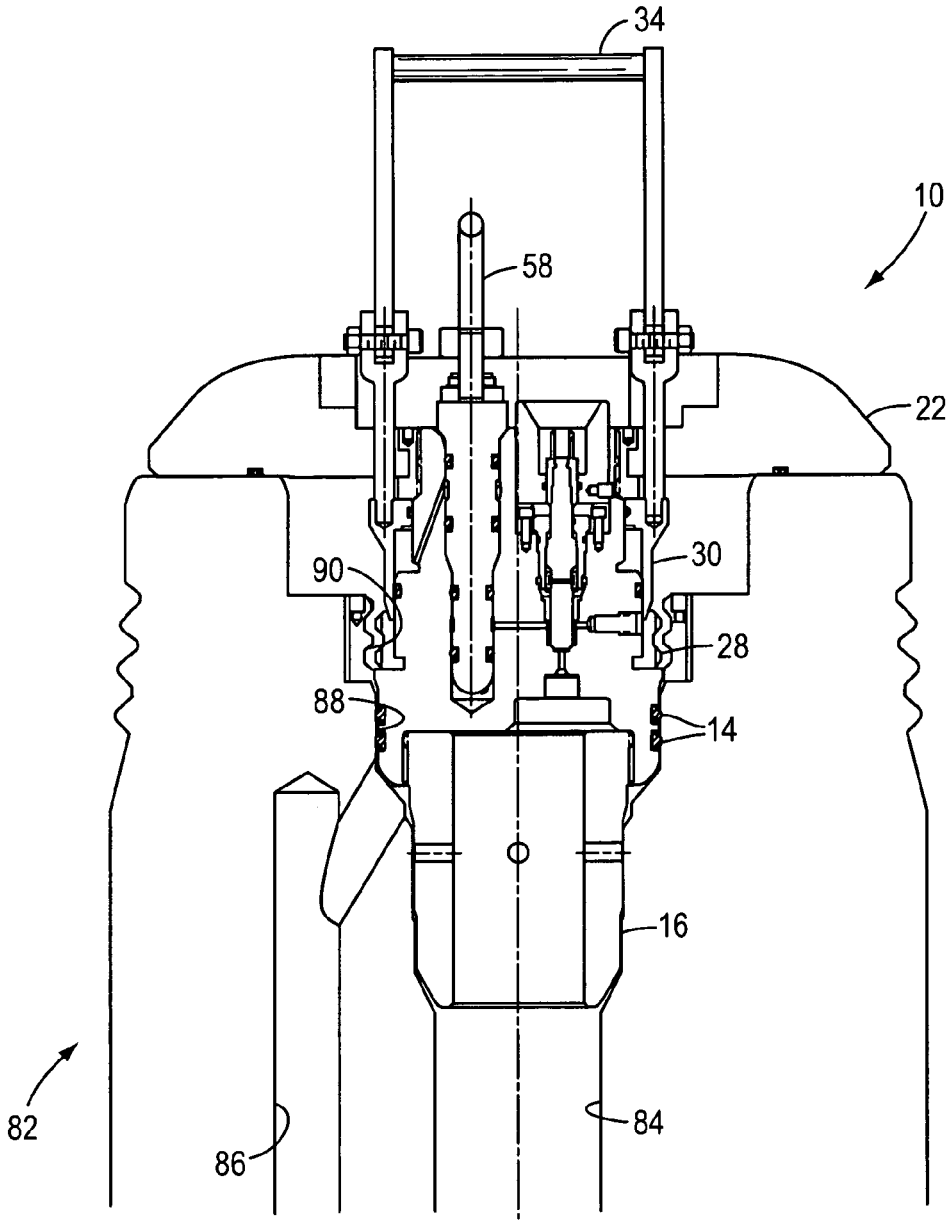
FIG. 3 is a cross sectional view of the tree cap of FIG. 1 shown installed in an exemplary christmas tree, with the lockdown ring disengaged.
Figure 4:
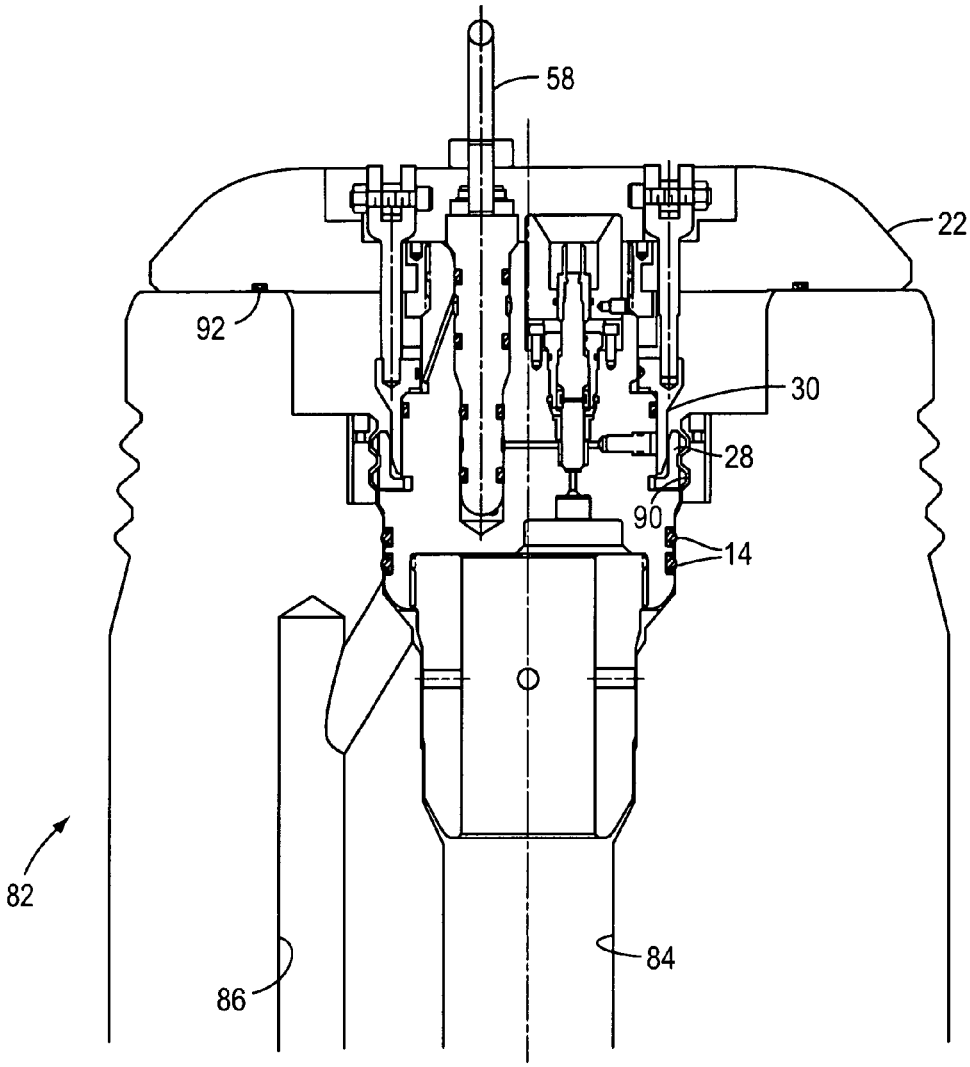
FIG. 4 is a cross sectional view similar to FIG. 3, but with the lockdown ring engaged.
Figure 8:
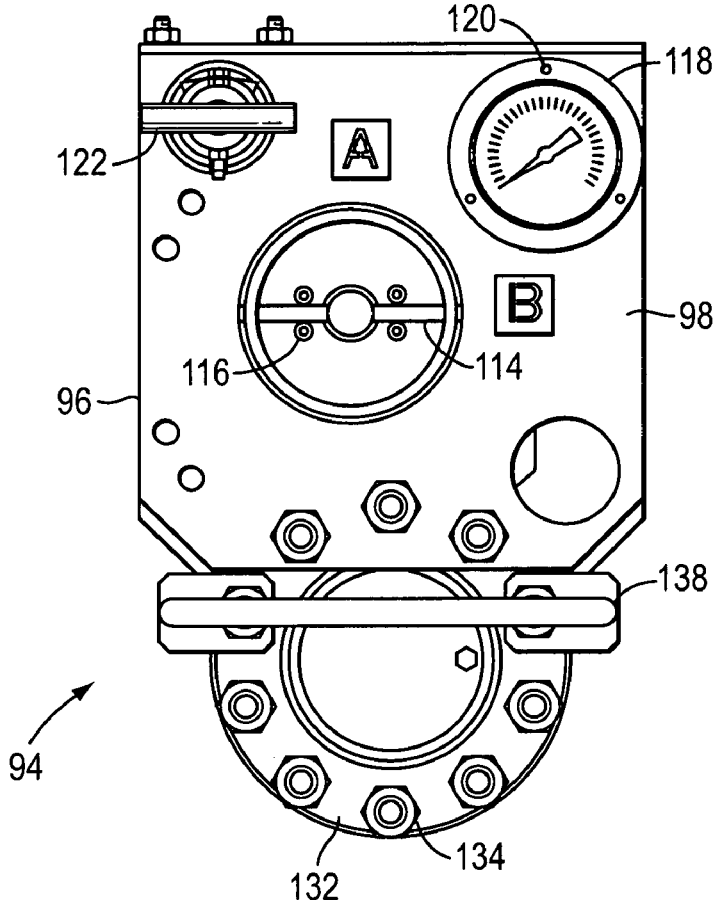
FIG. 8 is a front plan view of the ROV suction tool.
Figure 9:
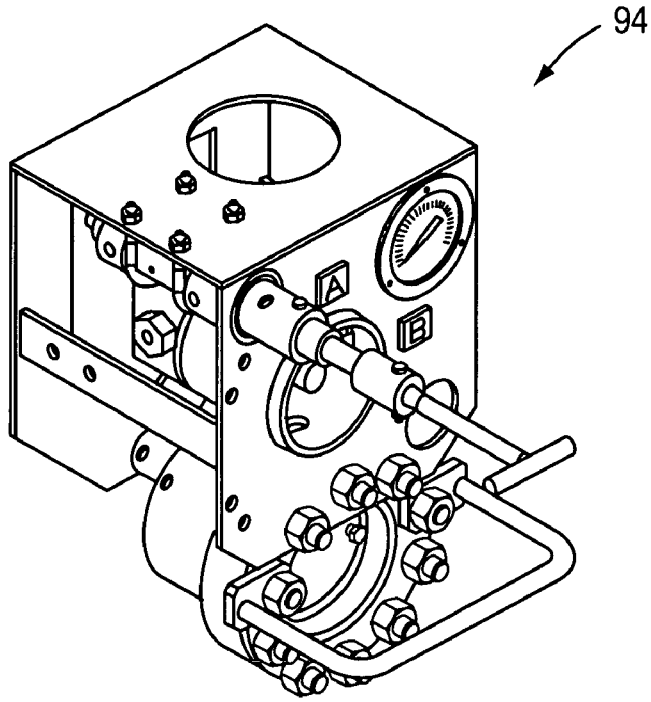
FIG. 9 is a perspective view of the ROV suction tool.

Referring also to FIGS. 3 and 4, an exemplary christmas tree 82 on which the tree cap 10 of the present invention may be installed is shown to comprise a production bore 84, an annulus bore 86, a cylindrical sealing surface 88 which is formed at an upper end of the production bore, and a lockdown profile 90 which is formed at the upper end of the production bore above the sealing surface. When it is desired to install the tree cap 10 on the tree 82, the handle 34 is rotated to the upper position shown in FIG. 3 and the lockdown piston 30 is moved to its retracted position, such as by pulling upwardly on the handle, thus allowing the lockdown ring 28 to contract against the seal plate 12. An ROV (not shown) is then preferably used to grasp the handle 34 and carry, or "fly", the tree cap 10 to the tree 82. During this procedure, the needle valve 64 is preferably in the closed position.

Using the stab nose 16 to guide the tree cap 10 into the production bore 84, the ROV then lowers the tree cap onto the tree 82 until the seals 14 are just in contact with sealing surface 88. In this position, the fluid pressure above and below the seals 14 is equal to the ambient hydrostatic pressure, and the tree cap 10 is ready to be fully installed in the tree 82. At this point, the ROV rotates the handle 34 to the lower position shown in FIG. 4, removes the dummy stab 58 from the hot stab bore 52, and inserts a dual port hot stab (not shown) into the hot stab bore. As will be described more fully below, the hot stab is connected to an ROV suction tool which is configured to selectively apply at least a partial vacuum to either port of the hot stab.

Once the dual port hot stab has been inserted into the hot stab bore 52, the ROV rotates the needle valve stem 68 to open the third fluid port 76. The ROV suction tool is then used to apply at least a partial vacuum to the lower port of the hot stab. This partial vacuum is communicated through the third fluid port 76, through the first fluid port 62, through the central bore 18 of the stab nose 16, and to the production bore 84 of the tree 82. As the pressure in the production bore 84 decreases, a pressure differential is created across seals 14 since the hydrostatic pressure above tree cap 10 remains unchanged. Thus, a downward force is exerted on the tree cap 10 which is equal to this pressure differential multiplied by the seal area. When this downward force is sufficient to overcome the frictional forces between the seals 14 and sealing surface 88, the tree cap 10 will slide downward into the production bore 84.

Once the tree cap 10 is fully seated in the tree 82, the needle valve 64 can be closed. In this position, an annular seal 92 which is mounted on the bottom of the upper body 22 seals against the top of the tree 82. The seal 92 is not intended to be a pressure containing seal, but rather only a barrier to prevent debris from entering the production bore 84.

The ROV suction tool is now used to apply at least a partial vacuum to the upper port of the dual port hot stab. This partial vacuum is communicated through the second fluid port 74 to the lockdown piston chamber 44. As the pressure decreases in the lockdown piston chamber 44, a pressure differential is created across the upper and lower seals 46, 48 sealing the lockdown piston 30 to the seal plate 12 due to the hydrostatic pressure outside the lockdown piston chamber. Consequently, a downward force is exerted on the lockdown piston 30 which is equal to this pressure differential multiplied by the annular cross-sectional seal area of the lockdown piston chamber 44. When this downward force is sufficiently large, the lockdown piston 30 will move downward and the chamfered lower end of the lockdown piston will force the lockdown ring 28 outwardly into engagement with the lockdown profile 90 to thereby secure the tree cap 10 to the tree 82. The hot stab can now be removed from the hot stab bore 52 and replaced with the dummy stab 58. This is the configuration shown in FIG. 4.

When it is desired to remove the tree cap 10 from the tree 82, the above steps are essentially reversed. The dummy stab 58 is removed from the hot stab bore 52, a dual port hot stab is inserted into the hot stab bore, and an ROV is used to apply hydraulic pressure to the lockdown piston chamber 44 to raise the lockdown piston 30 and thereby allow the lockdown ring 106 to contract out of engagement with lockdown profile 90. The ROV then opens the needle valve 64 and applies hydraulic pressure to the portion of the production bore 84 below the tree cap 10. Once the pressure in the production bore 84 exceeds the ambient hydrostatic pressure by a sufficient amount, the tree cap 10 will be driven out of the production bore 84. The ROV then closes the needle valve 64 and replaces the hot stab with the dummy stab 58. The ROV can then grasp the tree cap 10 via the handle 34 and move the tree cap to another tree or retrieve it to the surface. If desired, or when necessary due to a mechanical failure, the lockdown piston 30 can be actuated mechanically by manipulating the handle 34 with the ROV. In any event, it should be apparent from the foregoing discussion that the ROV suction tool is not required to remove the tree cap 10 from the tree 82.

Referring now to FIGS. 6 through 9, the ROV suction tool, generally 94, comprises a preferably metal frame 96 which includes a front or ROV panel 98, an upper panel 100, a rear panel 102, and a side brace 104 that extends between and is secured to the front and rear panels. The suction tool 94 also includes first and second bulkhead type hydraulic fittings 106 and 108 which are mounted on the side brace 104, a dual port hot stab manifold 110 which is attached to the upper panel 100 via brackets 112, a four-way ball valve 114 which is secured to the front panel 98 with screws 116 and is adapted to be manipulated by an ROV, and an optional pressure gage 118 which is mounted to the front panel with screws 120. A conventional dual port hot stab 122 from an ROV can be inserted into the hot stab manifold 110 through a corresponding opening in the front panel 98. The hot stab manifold 110 includes upper and lower ports 124 and 126, and the hot stab 122 can be used to supply hydraulic pressure to either of these ports.

The suction tool 94 further includes a vacuum pump 128 which comprises a cylinder housing 130, a cylinder end cap 132 which is connected to the cylinder housing with a number of studs and nuts 134, several of which are also used to secure the cylinder housing to the front panel 98, and an end cap seal 136 which is positioned between the cylinder housing and the cylinder end cap. The suction too 94 preferably also comprises and an ROV handle 138 which is connected to, for example, the cylinder housing with a number of the studs and nuts 134.

Referring to FIG. 7, the vacuum pump 128 also includes a first pressure chamber 140, a piston 142 which is sealed to the inner diameter of the cylinder housing 130 with a suitable seal 144, and a valve stem 146 which comprises a first end that is attached such as by threads to the piston and a second end that is sealed to the first pressure chamber by, e.g., an O-ring seal 148. Thus, the piston 142 defines a second pressure chamber 150 between the piston 142 and the seal 148 and a third pressure chamber 152 between the cylinder end cap 132 and the piston. Referring also to FIG. 6, the first pressure chamber 140 is accessible through a first port 154 in the cylinder housing 130, the second pressure chamber 150 is accessible through a second port 156 in the cylinder housing, and the third pressure chamber 152 is accessible through a third port 158 in the cylinder housing. The cylinder housing 130 also includes a vent port (not shown) which is connected to the second pressure chamber 150.

Referring now to FIG. 5, the lower port 124 in hot stab manifold 110 is connected to the first port 154 in the cylinder housing 130 via a hydraulic line 160. Similarly, the upper port 126 in the hot stab manifold 110 is connected to the third port 158 in the cylinder housing 130 via a hydraulic line 162. Also, the aforementioned vent port, which is indicated by reference number 164, is vented to the sea via a hydraulic line 166 and a check valve 168.

The ball valve 114 comprises an upper port 170 which is connected to the second port 156 in the cylinder housing 130 via a check valve 172 and a hydraulic line 174, which is also the hydraulic line to which the pressure gage 118 is connected. The ball valve 114 also comprises a left port 176 which is connected to the first bulkhead fitting 106 on the side brace 104 via a hydraulic line 178, a right port 180 which is connected to the second bulkhead fitting 108 via a hydraulic line 182, and a lower port 184 which is vented to the sea.

In FIG. 5, the ball valve 114 is shown in a first position in which the upper port 170 is connected to the left port 176 and the right port 180 is connected to the lower port 184. The ball valve 114 can be moved to a second position by rotating it through 90 degrees using an ROV. In this second position (not shown), the upper port 170 is connected to the right port 180 and the left port 176 is connected to the lower port 184.

A dual port hot stab 186, such as the one discussed above in connection with the tree cap 10, is connected to the ROV suction tool 94 via the first and second bulkhead fittings 106, 108. The first bulkhead fitting 106 is connected to an upper port 188 on the hot stab 186 via a hydraulic line 190. Similarly, the second bulkhead fitting 108 is connected to a lower port 192 on the hot stab 186 via a hydraulic line 194. The hot stab 186 may be connected to the frame 96 of the suction tool 94. Alternatively, the hot stab 186 may be a separate component which is manipulated by the ROV independent of the suction tool 94. In the latter case, the first and second bulkhead fittings 106, 108 may be connected to the upper and lower ports on the hot stab 186 by hand prior to deployment, or by the ROV after the hot stab has been inserted into the hot stab bore 52 in the tree cap 10.

Thus, provided the hot stab 186 is inserted into the tree cap 10, the tree cap is at least partially installed in the tree 182 and the needle valve 64 is open, when the ball valve 114 is in its second position the production bore 84 will be in fluid communication with the second pressure chamber 150 in the vacuum pump 128 and the lockdown piston chamber 44 will be vented to the sea. Also, when the ball valve 114 in its first position, the lockdown piston chamber 44 will be in fluid communication with the second pressure chamber 150 and the production bore 84 will be vented to the sea.

When it is desired to fully seat the tree cap 10 on the tree 82, the ball valve 114 is rotated to its second position and hydraulic pressure is applied by the ROV to the upper port of the hot stab 122 which is positioned in the hot stab manifold 110. This will pressurize the third pressure chamber 152 in the cylinder housing 130 and thereby force the piston 142 to the left most position (as viewed in FIG. 7). During this step, any fluid within the second pressure chamber 150 will be vented to the sea through the vent port 164 and the check valve 168. Also, the check valve 172 will prevent any outward fluid flow through the second port 156. Once the piston 142 is in the left most position, pressure is removed from the upper port of the hot stab 122 and applied to the lower port to thereby pressurize the first pressure chamber 140. As the stem 146 and the piston 142 move to the right, a partial vacuum will be created in the second pressure chamber 150. Since the check valve 168 prevents fluid from flowing into the second pressure chamber 150 through the vent port 164, this partial vacuum will be communicated through the hydraulic line 174, the ball valve 114, the hot stab 186, and ultimately to the production bore 84 of the tree 82. Consequently, any fluid in the production bore 84 will be sucked into the second pressure chamber 150. This fluid is subsequently purged to the sea through the vent port 164 by depressurizing the first pressure chamber 140 and pressurizing the third pressure chamber 152. By repeating this cycle, the pressure in the production bore 84 can be pumped down until sufficient vacuum is created to draw the tree cap 10 down onto the tree 82.

Once the tree cap 10 is firmly seated on the tree 82, the needle valve is closed to retain the partial vacuum below the tree cap, the ball valve 114 is rotated to its first position, and the vacuum pump 128 is cycled as previously discussed. Now the partial vacuum which is created in the second pressure chamber 150 is communicated through the ball valve 114, through the hot stab 186, and ultimately to the lockdown piston chamber 44. As a result, the lockdown piston 30 will actuate the lockdown ring 28 as previously described to lock the tree cap 10 to the tree 82. The hot stab 186 may then be removed from the tree cap 10 and replaced with the dummy stab 58.

When it is desired to remove the tree cap 10 from the tree 170, the dummy stab 58 is removed and replaced with the hot stab 122 from the ROV. The upper port of the hot stab 122 is then pressurized to pressurize the lockdown piston chamber 44 and thereby force the lockdown piston 30 out of engagement with the lockdown ring 28 as previously described. The needle valve 64 is then opened and the lower port of the hot stab 122 is pressurized to pressurize the production bore 84 and thereby drive the tree cap 10 out of the tree 82.

Although the present invention has been described in connection with a tree cap for a subsea christmas tree, the person of ordinary skill in the art will readily understand how to apply the above teachings to any component which that person desired to attach to another component. Provided the first component includes a depending portion and the second component includes a bore which is sized and configured to receive the depending portion, the present invention teaches that these components may be attached by inserting the depending portion at least partially into the bore and thereafter creating a relative vacuum in the bore. The relative vacuum will cause the ambient pressure of a surrounding fluid to force the depending portion into the bore and thereby attach the first component to the second component. For purposes of this application, the word bore should be construed to include any hole, orifice or other such cavity within which the depending portion may be inserted. In addition, the word fluid should be construed to include water, gas, air or any other medium to which the components or any portion of the components may be exposed.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A method for attaching a first component which comprises a depending portion to a second component which comprises a bore that is sized and configured to receive the depending portion, the first and second components being exposed to a fluid which is at an ambient pressure, the method comprising the steps of:

inserting the depending portion partially into the bore; and creating a bore pressure within the bore which is less than the ambient pressure;

wherein a pressure difference between the ambient pressure and the bore pressure will move the depending portion into the bore to thereby attach the first component to the second component.

2. The method of claim 1, further comprising the step of providing a seal on at least one of the depending portion and the bore.

3. The method of claim 2, wherein the inserting step comprises the step of inserting the depending portion into the bore until the seal engages both the depending portion and the bore.

4. The method of claim 1, wherein the pressure creating step comprises the step of removing at least a portion of the fluid from the bore.

5. The method of claim 4, wherein the fluid removal step comprises the steps of:

providing a fluid conduit which extends through at least one of the first and second components and communicates with the bore; and removing the fluid through the fluid conduit.

6. The method of claim 5, wherein the fluid removal step further comprises the steps of:

providing a vacuum means; and fluidly connecting the vacuum means to the fluid conduit.

7. The method of claim 6, wherein the vacuum providing step comprises the step of providing a self-contained vacuum means which is sufficiently light weight to be carried by an ROV.

8. The method of claim 1, further comprising the step of mechanically locking the first component to the second component.

9. The method of claim 8, wherein the locking step comprises the steps of:

providing a locking profile on at least one of the first and second components;

providing a lockdown ring and a lockdown piston on the other of the first and second components; and actuating the lockdown piston into engagement with the lockdown ring to force the lockdown ring into engagement with the locking profile.

10. The method of claim 9, wherein the actuating step comprises the step of:

creating a pressure within a volume adjacent the lockdown piston which is less than the ambient pressure;

wherein the ambient pressure will force the lockdown piston into engagement with the lockdown ring.

11. The method of claim 10, wherein the pressure creating step comprises the steps of:

providing a fluid conduit which extends through at least one of the first and second components and communicates with the volume adjacent the lockdown piston; and removing the fluid within the volume through the fluid conduit.

12. The method of claim 11, wherein the fluid removal step further comprises the steps of:

providing a vacuum means; and fluidly connecting the vacuum means to the fluid conduit.

13. The method of claim 12, wherein the vacuum providing step comprises the step of providing a self-contained vacuum means which is sufficiently light weight to be carried by an ROV.

14. An apparatus for attaching a first component which comprises a depending portion to a second component which comprises a bore that is sized and configured to receive the depending portion, the first and second components being exposed to a fluid which is at an ambient pressure, the apparatus comprising:

a fluid conduit which extends through at least one of the first and second components and communicates with the bore; and means in fluid communication with the fluid conduit for removing at least a portion of the fluid from the bore;

wherein when the depending portion is inserted partially into the bore, the fluid removing means will create a bore pressure within the bore which is less than the ambient pressure; and wherein a pressure difference between the ambient pressure and the bore pressure will move the depending portion into the bore to thereby attach the first component to the second component.

15. The apparatus of claim 14, further comprising a seal which is mounted on at least one of the first and second components and is adapted to seal between the depending portion and the bore.

16. The apparatus of claim 14, wherein the fluid removing means comprises a vacuum pump.

17. The apparatus of claim 16, wherein the vacuum pump is mounted on a suction tool which is sufficiently lightweight to be carried by an ROV.

18. The apparatus of claim 16, further comprising means for actuating the vacuum pump.

19. The apparatus of claim 18, wherein the actuating means comprises a hydraulic pressure source.

20. The apparatus of claim 19, further comprising means for communicating the hydraulic pressure source to the vacuum pump.

21. The apparatus of claim 20, wherein the communicating means comprises a hot stab manifold which is fluidly connected to the vacuum pump.

22. The apparatus of claim 19, wherein the hydraulic pressure source is mounted on an ROV which includes a hot stab that is adapted to be received in the hot stab manifold to thereby fluidly connect the hydraulic pressure source to the vacuum pump.

23. The apparatus of claim 16, further comprising:

a hot stab bore which is in fluid communication with the fluid conduit; and a hot stab which is fluidly connected to the vacuum pump;

wherein the hot stab is adapted to be received in the hot stab bore to thereby fluidly connect the vacuum pump to the fluid conduit.

24. The apparatus of claim 14, further comprising means for selectively opening and closing the fluid conduit.

25. The apparatus of claim 24, wherein the opening and closing means comprises a needle valve.

26. The apparatus of claim 25, wherein the needle valve may be actuated by an ROV.

27. The apparatus of claim 14, further comprising means for locking the first component to the second component.

28. The apparatus of claim 27, wherein the locking means comprises:

a locking profile which is located on one of the first and second components;

a lockdown ring which is positioned on the other of the first and second components and is adapted to engage the locking profile to thereby lock the first component to the second component.

29. The apparatus of claim 28, further comprising:

a lockdown piston which is positioned on the other of the first and second components adjacent the lockdown ring; and means for actuating the lockdown piston into engagement with the lockdown ring to force the lockdown ring into engagement with the locking profile.

30. The apparatus of claim 29, wherein the actuating means comprises the removing means.

31. The apparatus of claim 30, further comprising;

a second fluid conduit which extends through at least one of the first and second components and communicates with a volume adjacent the lockdown piston;

wherein the removing means is selectively fluidly connectable to the second fluid conduit to thereby create a pressure within the volume adjacent the lockdown piston which is less than the ambient pressure; and wherein the ambient pressure will force the lockdown piston into engagement with the lockdown ring.

32. An apparatus for attaching a tree cap which comprises a depending seal plate to a subsea christmas tree which comprises a bore that is sized and configured to receive the seal plate, the tree cap and the christmas tree being exposed to a surrounding fluid which is at an ambient pressure, the apparatus comprising:

a fluid conduit which extends through at least one of the tree cap and the christmas tree and communicates with the bore; and means in fluid communication with the fluid conduit for removing at least a portion of the fluid from the bore;

wherein when the seal plate is inserted at least partially into the bore, the fluid removing means will create a bore pressure within the bore which is less than the ambient pressure; and wherein a pressure difference between the ambient pressure and the bore pressure will force the seal plate into the bore to thereby attach the tree cap to the christmas tree.

33. The apparatus of claim 32, further comprising a seal which is mounted on at least one of the tree cap and the christmas tree and is adapted to seal between the seal plate and the bore.

34. The apparatus of claim 32, wherein the fluid removing means comprises a vacuum pump.

35. The apparatus of claim 34, wherein the vacuum pump is mounted on a suction tool which is sufficiently lightweight to be carried by an ROV.

36. The apparatus of claim 34, further comprising means for actuating the vacuum pump.

37. The apparatus of claim 36, wherein the actuating means comprises a hydraulic pressure source.

38. The apparatus of claim 37, further comprising means for communicating the hydraulic pressure source to the vacuum pump.

39. The apparatus of claim 38, wherein the communicating means comprises a hot stab manifold which is fluidly connected to the vacuum pump.

40. The apparatus of claim 39, wherein the hydraulic pressure source is mounted on an ROV which includes a hot stab that is adapted to be received in the hot stab manifold to thereby fluidly connect the hydraulic pressure source to the vacuum pump.

41. The apparatus of claim 34, further comprising:

a hot stab bore which is in fluid communication with the fluid conduit; and a hot stab which is fluidly connected to the vacuum pump;

wherein the hot stab is adapted to be received in the hot stab bore to thereby fluidly connect the vacuum pump to the fluid conduit.

42. The apparatus of claim 32, further comprising means for selectively opening and closing the fluid conduit.

43. The apparatus of claim 42, wherein the opening and closing means comprises a needle valve.

44. The apparatus of claim 43, wherein the needle valve may be actuated by an ROV.

45. The apparatus of claim 32, further comprising means for locking the tree cap to the christmas tree.

46. The apparatus of claim 45, wherein the locking means comprises:

a locking profile which is located on one of the tree cap and the christmas tree;

a lockdown ring which is positioned on the other of the tree cap and the christmas tree and is adapted to engage the locking profile to thereby lock the tree cap to the christmas tree.

47. The apparatus of claim 46, further comprising:

a lockdown piston which is positioned on the other of the tree cap and the christmas tree adjacent the lockdown ring; and means for actuating the lockdown piston into engagement with the lockdown ring to force the lockdown ring into engagement with the locking profile.

48. The apparatus of claim 47, wherein the actuating means comprises the removing means.

49. The apparatus of claim 48, further comprising;

a second fluid conduit which extends through at least one of the tree cap and the christmas tree and communicates with a volume adjacent the lockdown piston;

wherein the removing means is selectively fluidly connectable to the second fluid conduit to thereby create a pressure within the volume adjacent the lockdown piston which is less than the ambient pressure; and wherein the ambient pressure will force the lockdown piston into engagement with the lockdown ring.

* * * * *